United States Patent [19]

Jordan et al.

[11] 4,114,770

[45] Sep. 19, 1978

[54] IMPLEMENT FOR HANDLING A BULK TOBACCO CONTAINER

[75] Inventors: Bertram Lee Jordan; John Davis Mitchell, both of Lewiston, N.C.

[73] Assignee: Harrington Manufacturing Company, Lewiston, N.C.

[21] Appl. No.: 732,798

[22] Filed: Oct. 15, 1976

[51] Int. Cl.[2] ..... A24B 1/02

[52] U.S. Cl. ..... 214/130 R; 214/766; 294/5.5

[58] Field of Search ..... 214/5.5, 130 R, 130 A, 214/130 C, 313, 620, 766, DIG. 4; 294/5.5; 280/415 A, 460 A; 56/27.5

[56] References Cited

U.S. PATENT DOCUMENTS

| | | | |
|---|---|---|---|
| 2,714,460 | 8/1955 | Cook | 214/766 |
| 2,730,252 | 1/1956 | Oswalt | 214/130 R X |
| 2,860,797 | 11/1958 | Wilcox | 214/313 |
| 3,391,949 | 7/1968 | Abbott | 280/415 A |
| 3,674,161 | 7/1972 | Grinde | 214/130 R |
| 3,834,137 | 9/1974 | Long | 294/5.5 X |
| 3,932,946 | 1/1976 | Johnson | 294/5.5 X |
| 3,948,553 | 4/1976 | Suggs | 294/5.5 |
| 3,957,167 | 5/1976 | Jacobson et al. | 214/766 |

*Primary Examiner*—L. J. Paperner
*Attorney, Agent, or Firm*—Mills & Coats

[57] ABSTRACT

The present invention relates to a tractor mounted implement for handling a box type bulk tobacco container. The implement is adapted to be connected to a conventional three-point hitching mechanism disposed about the rear of the tractor which generally extends rearwardly from the rear of the tractor and includes a pair of spaced apart support arms adapted to be positioned into engagement with stub shafts extending from the side of the particular bulk tobacco container being handled. By actuating the hydraulic control system of the tractor, the three-point hitching mechanism can be raised and lowered so as to adjust the height of the handling implement.

4 Claims, 4 Drawing Figures

IMPLEMENT FOR HANDLING A BULK TOBACCO CONTAINER

The present invention relates to material handling implements and devices, and more particularly to a tractor mounted transport and handling implement for bulk tobacco containers.

BACKGROUND OF THE INVENTION

Bulk tobacco barns used for curing and drying tobacco are now provided with relatively large bulk containers that are often referred to as curing boxes or containers and which are of the general type shown and disclosed in U.S. Pat. No. 3,948,553. Such curing boxes are often directly filled during the tobacco harvesting operation while stationed on a trailer that is supported by a tobacco harvester. Once the containers have been filled, they are typically transferred to the curing and drying site while still stationed on the same trailer. At the curing and drying site, it is necessary to remove the curing boxes or containers from the trailer and to appropriately place them within the curing and drying structure or barn prior to beginning the curing and drying process. It has been suggested, for example, that a fork lift could be utilized to lift and transport the curing boxes or containers between desired locations. Also, it is known that a large bulk container may be moved from a trailer or other area of support to a position adjacent the front of a curing and drying structure to where the same may be moved therein by a chain hoist assembly supported by an overhead beam. Various other handling and transport devices compatible with bulk tobacco curing boxes or containers are shown in U.S. Pat. No. 3,948,553 and U.S. Pat. No. 3,888,533.

It should be noted that such curing boxes are extensively used throughout the harvesting, and curing and drying season. Not only are the curing boxes transported to and from the field during the actual harvesting operation, but once the curing and drying process is completed, the curing boxes must be removed from the curing and drying structure, tobacco removed therefrom, and the boxes positioned for storage until they are ready to be used again. Generally these curing boxes or containers, even when empty, are too large, bulky and heavy to be handled by hand efficiently and effectively.

SUMMARY OF THE INVENTION

The present invention presents a relatively simple and inexpensive tractor mounted implement that is capable of efficiently and effectively handling a bulk tobacco container of the type shown and disclosed in U.S. Pat. No. 3,948,553. The implement of the present invention is adapted to be connected to a conventional three-point hitching mechanism of a farm tractor and once connected to the tractor, the attitude and general position of the implement can be controlled by the hydraulic lift system of the tractor and/or by a separate remotely controlled hydraulic cylinder. Basically, the implement of the present invention includes a pair of lift arms that extend rearwardly from the tractor and wherein the lift arms are particularly adapted to engage a pair of outwardly extending stub shafts that extend from the side of the particular bulk tobacco container to be transported. Once properly engaged underneath the particular stub shafts of the bulk tobacco container, the bulk tobacco container can be lifted, transported, and appropriately positioned.

It is, therefore, an object of the present invention to provide a relatively simple, inexpensive, and easy to use handling device for a bulk tobacco container of the box or container type.

A further object of the present invention is to provide a handling device for a bulk tobacco container that is adapted to be connected and supported by a three-point hitching mechanism of a tractor.

Another object of the present invention is to provide a handling device for a bulk tobacco container of the type having a pair of outwardly extending stub shafts on the sides thereof, wherein said handling device is easy to manipulate and control and which is relatively easy to position underneath the stub shafts for properly lifting and supporting the bulk tobacco container.

A further object of the present invention is to provide a tractor mounted bulk tobacco container handling implement that is relatively strong and sturdy and which exerts a positive and reliable holding force on the bulk container when lifted and being transported.

Other objects and advantages of the present invention will become apparent from a study of the following description and the accompanying drawings which are merely illustrative of the present invention.

DESCRIPTION OF PREFERRED EMBODIMENT

Figure 1:
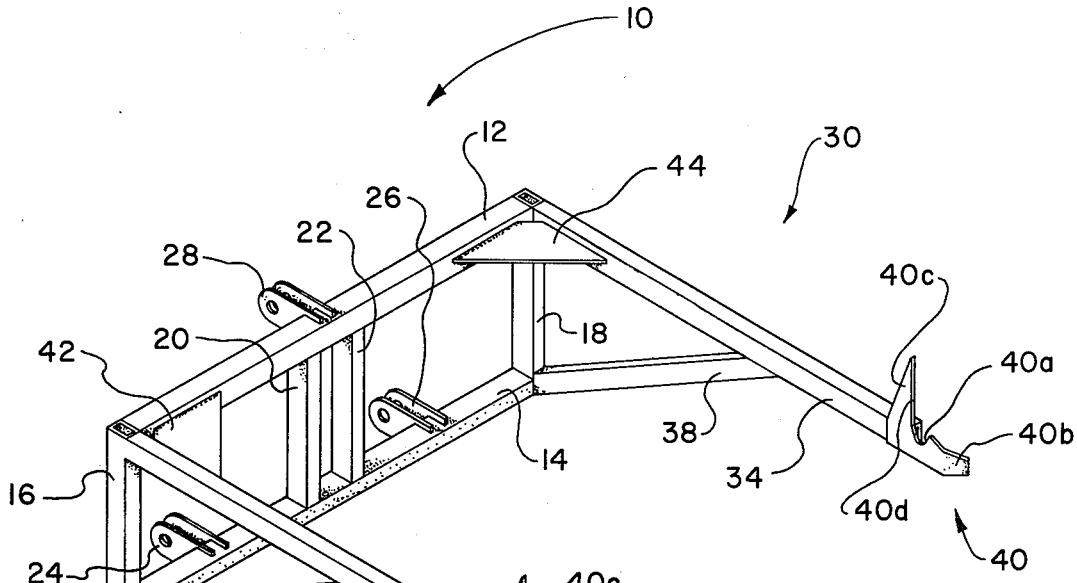
FIG. 1 is a perspective view of the bulk tobacco container handling implement of the present invention.
Figure 3:
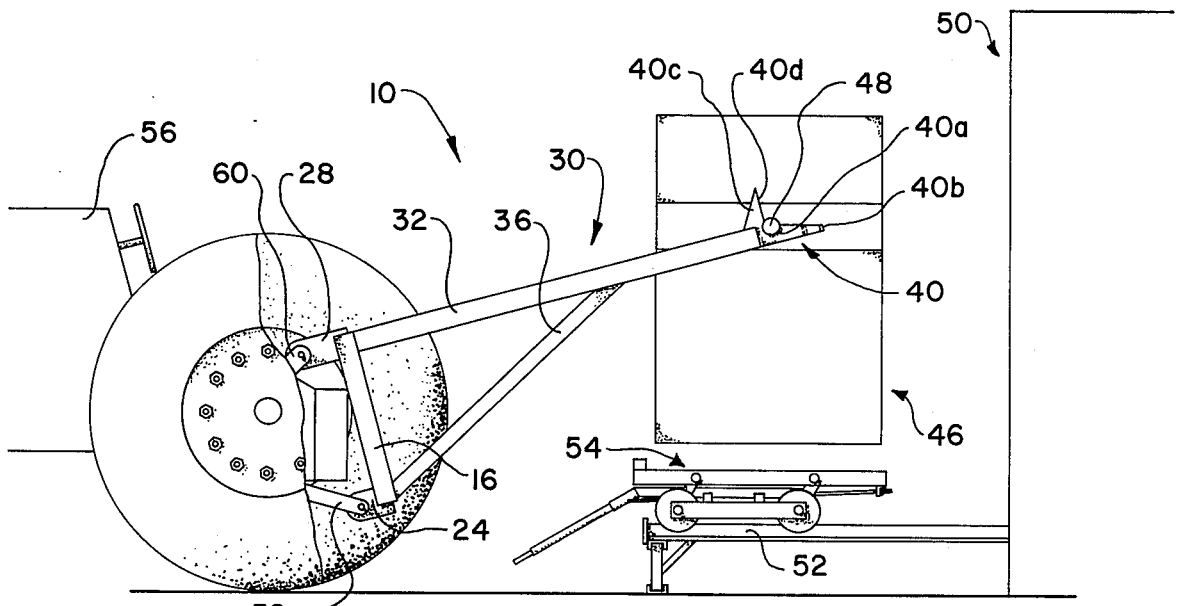
FIG. 3 is a side elevational view of the implement of the present invention engaged with and supporting a bulk tobacco container above a transport dolly disposed adjacent the front end of a bulk tobacco barn, said implement being connected to the three-point hitching mechanism of a tractor and extending generally rearwardly therefrom.
Figure 4:
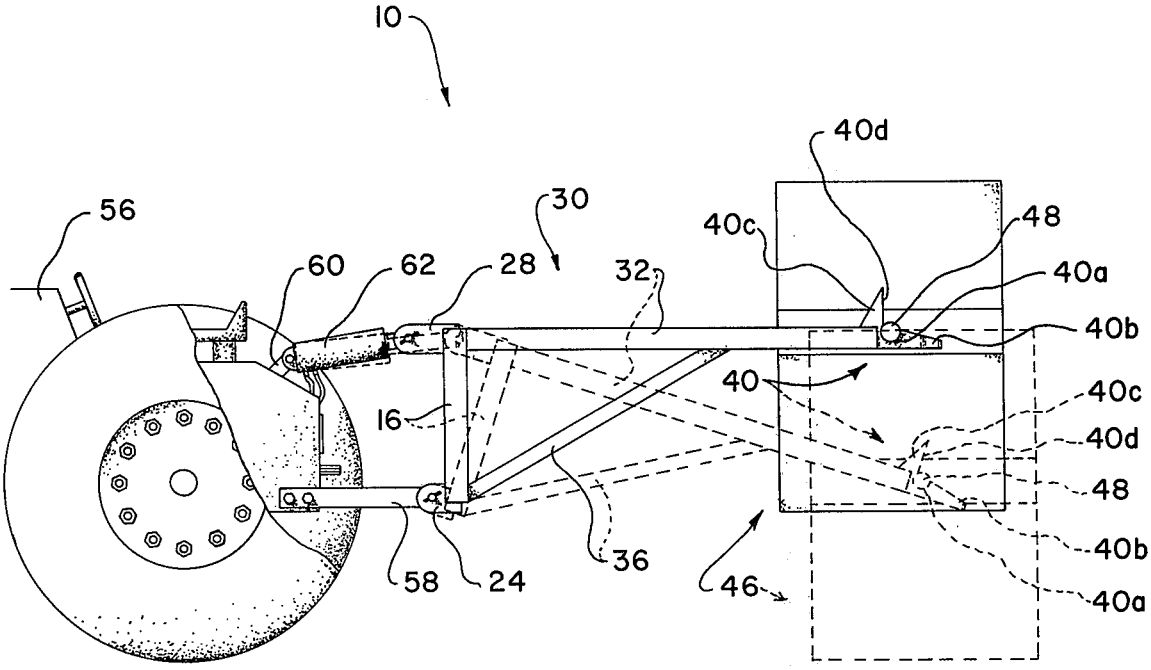
FIG. 4 is a side elevational view of the handling implement of the present invention also connected to the three-point hitching mechanism of a tractor with the additional provision of a remotely controlled hydraulic cylinder operatively connected between the tractor and the implement for further controlling the angle of the lift arms of the implement and for particularly raising and lowering the rearward ends of the lift arms with respect to the lower front portion of the implement.

With further reference to the drawings, particularly FIGS. 1, 3 and 4, the bulk tobacco container handling implement of the present invention is shown therein and indicated generally by the numeral 10. Viewing implement 10, it is seen that the same includes a hitching frame that includes an upper transverse member 12 and a lower transverse member 14, members 12 and 14 being secured one above the other by a pair of end posts 16 and 18. In addition, additional support is provided by the provision of two intermediate supports 20 and 22 that also extend between the upper and lower transverse members 12 and 14. It is thusly seen that members 12, 14, 16 and 18 form a generally rectangular hitching frame.

The hitching frame just described is adapted to be connected to the three-point hitching assembly or mechanism of a conventional farm tractor 56. In this regard, there is provided two lower connecting points 24 and 26, and an upper center connecting point 28. In any case, the connecting points are of a general clevis design in that each comprises a pair of connecting plates extending from the hitching frame in parallel relationship and having aligned openings formed therein for receiving a connecting pin. It will be appreciated that respective connecting members from the tractor's three-point hitch will be received between the respective plates of the connecting points 24, 26 and 28.

Figure 2:
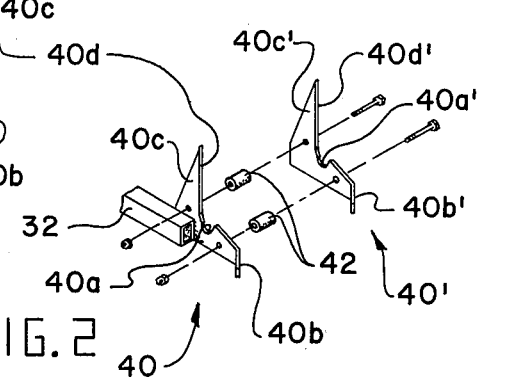
FIG. 2 is a fragmentary perspective view which illustrates the additional use of an auxiliary end support member to vary the effective width of the bulk tobacco container handling implement of the present invention.

Extending rearwardly from the implement's hitching frame as an arm assembly means, indicated generally by the numeral 30, and including a pair of laterally spaced support or lift arms 32 and 34. As a part of the arm assembly means 30, there is provided two diagonal braces 36 and 38 that extend between the lower transverse member 14 and respective intermediate points on the support arms 32 and 34, as seen in FIGS. 1 and 2.

Secured to the rearmost terminal end of each of the support arms 32 and 34 is a support member, indicated generally by the numeral 40, that is adapted to engage and support outwardly extending support means extending from the conventional bulk tobacco container, indicated generally by the numeral 36, and to be discussed subsequently herein. Viewing each support member 40 in more detail, it is seen that the same comprises a generally irregular shaped metal plate that includes a seat area 40*a* defined about the upper edge thereof, the seat area 40*a* being generally arcuately shaped and adapted to receive and support a respective stub shaft 48 that extends from a side of the bulk tobacco container 46, as viewed in FIGS. 3 and 4. Continuing to refer to each support member 40, it is seen that just rearwardly of the defined seat area 40*a* is an outwardly projecting guide flange 40*b*. Disposed behind or forwardly of the seat area 40*a* and on the side opposite the guide flange 40*b* is an elevated back stop 40*c*. It is seen that the back stop extends above the seat area 40*a* and includes a generally slanted face edge 40*d* that extends upwardly to form an apex with the forwardmost edge of the support member 40, as viewed in FIGS. 3 and 4 (the forward direction being in the direction of the tractor and the rearward direction being in the direction of the bulk tobacco container 46).

To assure that the implement 10 is strong and sturdy and can withstand the wear and tear that it might encounter in operation, a pair of gussets 42 and 44 are provided between the hitching frame and the arm assembly means 30. In particular, each gusset 42 and 44 is secured by weldment or other suitable means between the upper transverse member 12 and a respective support arm 32 or 34 (FIG. 1).

With respect to the bulk tobacco container 46, sometimes referred to as a curing box or curing container, details of this structure will not be dealt herein as such bulk tobacco containers are now presently being manufactured and sold by the agricultural machinery industry today and the construction and details of such are well known and appreciated by those skilled in the art. For a complete and unified understanding of such a bulk tobacco container, one is referred to U.S. Pat. No. 3,948,553. But briefly, it should be noted that such a container is filled with tobacco leaf material either during the harvesting operation or at some appropriate time thereafter. These bulk tobacco containers 46 are adapted to be placed in a conventional bulk tobacco curing and drying structure, generally indicated by the numeral 50 in FIG. 3.

The implement 10 of the present invention is particularly adapted to support and handle a bulk tobacco container of the type having support means that extend outwardly therefrom, such as the stub shaft 48 shown in FIGS. 3 and 4. When filled, these bulk tobacco containers 46 may weigh in excess of 1,000 pounds and the implement of the present invention is designed to provide an efficient and effective means for supporting and handling such bulk tobacco containers in and around the curing and drying site. In this regard, the implement 10 is adapted to be connected to a conventional three-point hitching assembly or mechanism of the farm tractor 56. For the purpose of explanation, the three-point hitching assembly or mechanism of the tractor 56 will be said to include a pair of lower draft links 58 that may be hydraulically powered in order that any implement connected to the three-point hitching assembly can be raised and lowered. In addition, the three-point hitching assembly includes an upper center link 60.

In operation, the tractor 56 is backed into alignment with the hitching frame and the lower two connecting points 24 and 26 are connected to respective lower draft links 58. The upper center connecting point 28 can be connected directly to the upper center link 60 of the three-point hitch or one end of a hydraulic cylinder 62 that is connected to the upper center link 60. In either case, once the implement 10 is connected to the three-point hitch of the tractor 56, then the operator can use the same to engage, lift, support, transport, and generally handle the bulk tobacco container 46 in and around the curing and drying barn.

To pick up a bulk tobacco container, the implement 10 is aligned with the container 46 and the tractor is backed into engagement therewith such that the arms generally pass outside of the respective sides of the bulk tobacco container. The implement 10 during this pick-up operation is lowered such that the support members 40 are disposed below the level of the stub shaft 48. Once the implement has been backed to where the support members 40 generally underlie the stub shafts 48, the tractor operator can then lift the implement 10 by hydraulically actuating the draft links 58, or the hydraulic cylinder 62, or a combination of both, causing the rear ends of the arms 32 to generally move up to where the support members 40 engage the stub shafts 48 of the bulk tobacco container. If the seat area 40*a* of each support member 40 does not precisely align with the stub shafts 48, then the back stop 40*c* (if they engage the stub shaft along the rearmost edges 40*d* thereof) will generally guide and urge the respective stub shafts downwardly to where they rest in the defined seat area 40*a*. Once the stub shafts 48 are correctly located within the support members 40, the bulk tobacco container 46 can be raised to an appropriate level and transported to a place for release.

It should be pointed out that when positioning the arms 32 and 34 about the bulk tobacco container 46, that the outwardly projecting guide flanges 40*b* formed about the rearmost end of the support members 40 will tend to guide the bulk tobacco container between the two arms 32 and 34 and consequently correct for slight errors in misalignment.

It is particularly desirable to use the implement 10 of the present invention in filling the curing and drying structure 50 during the tobacco harvesting operation. This entails picking up the bulk tobacco container 46 as just described, for example, from a trailer that brings one or more bulk tobacco containers to the curing and drying site, and then transporting the container to the front of the barn 50 where the same is placed onto a dolly 54 that is disposed exteriorly of the barn 50 about an extension rail assembly 52. Thus, the tractor 56 is positioned such that the raised and supported bulk tobacco container is disposed directly over the dolly 54, as illustrated in FIG. 3. Once again to lower the bulk tobacco container, the tractor's hydraulic system that controls the draft links 58 of the three-point hitch or the remotely controlled hydraulic cylinders 62, or a combination of both, is actuated such that the bulk container is lowered directly onto the dolly 54. Once the bulk tobacco container comes into contact with the dolly 54 and is in fact supported by the dolly, the support arms 32 and 34 are continued to be lowered until the stub shafts 38 are no longer engaged. At this point the tractor 56 can be moved forwardly and the implement 10 becomes disassociated with the bulk tobacco container 36 and the container is ready to be properly positioned within the bulk barn 50.

FIG. 2 illustrates a modification of the implement 10 to accommodate bulk tobacco container 46 of a width less than the width primarily designed for in the case of a structure such as that shown in FIG. 1. By the addition of an inside support member 40', the width between respective support members can be reduced and consequently the implement can be modified to accommodate smaller width containers. As seen in FIG. 2, an additional support member 40' can be secured inwardly of the support member 40 secured directly to the rearmost end of a respective support arm 32 or 34. In the embodiment illustrated in FIG. 2, the support member 40' can be secured to the main support member 40 by the provision of a plurality of spacers 42 and 44 and the bolting of the additional support member 40' through the spacers and to the original support member 40. The final distance between the innermost support members 40' will be determined and can be varied by the length of the spacers 42 and 44 and the securing bolt used.

From the foregoing specification, it is apparent that the present invention presents a handling implement 10 that is adapted to be connected to the three-point hitching assembly of a conventional farm tractor and be used to handle and transport conventional bulk tobacco containers in and around a bulk tobacco curing barn. Of particular importance is the fact in that the implement can be supported and powered by a conventional farm tractor that a farmer would usually have on hand. Also, the implement 10 is designed to be conveniently and easily used by tobacco farmers in handling and transporting bulk tobacco containers.

The terms "upper", "lower", "forward", "rearward", etc., have been used herein merely for the convenience of the foregoing specification and in the appended Claims to describe the implement for handling a bulk tobacco container and its parts as oriented in the drawings. It is to be understood, however, that these terms are in no way limiting to the invention since the implement for handling a bulk tobacco container may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A tractor carried bulk tobacco container handling implement adapted to be connected to a three-point hitching mechanism of a farm tractor for supporting and handling a bulk tobacco container of the type having outwardly extending support means extending from the sides thereof, said bulk tobacco container handling implement comprising: a rectangular hitching frame adapted to be operatively connected to the three-point hitching mechanism of a farm tractor, said hitching frame including an upper transverse member, a lower transverse member normally spaced below said upper transverse member, a pair of laterally spaced end connecting members connected between respective ends of said upper and lower transverse members such that a rectangular frame is formed by said upper and lower transverse member and said end connecting members; three-point hitch connecting means secured to said rectangular hitching frame for operatively connecting said implement to the three-point hitching mechanism of said farm tractor; a pair of laterally spaced support arms secured to said rectangular hitching frame and extending generally rearwardly therefrom when attached to said tractor; a pair of diagonal braces secured between said hitching frame means and said laterally spaced rearwardly extending support arms, each diagonal brace secured about one end to a lower portion of said hitching frame means and extending upwardly therefrom where the other end thereof joins a respective support arm intermediately the respective ends thereof; container support means disposed about the ends of each of said support arms about the rearward ends thereof opposite said hitching frame for engaging and supporting the outwardly extending support means of said bulk tobacco container, said container support means including a single one piece support member disposed about the rearward end of each support arm about the inner side thereof and wherein each support member comprises a generally arcuately shaped seat area defined for supporting said outwardly extending support means extending from said bulk tobacco container, an outwardly flanged guide portion integrally formed in said single one piece support member rearwardly of said seat area for guiding and aligning said bulk tobacco container handling implement with a bulk tobacco container to be engaged by said implement, and an elevated back disposed immediately adjacent said seat area opposite said flanged guide portion and extending above the area of said defined seat area for appropriately engaging said outwardly extending support means extending from the sides of said bulk container when said implement is being positioned and maneuvered to pick up a particular bulk tobacco container; and insert means insertable between each respective support arm and each single one piece support member for varying the effective width between said two support members of said bulk tobacco container handling implement.

2. The bulk tobacco container handling implement of claim 1 wherein said connecting means on said hitching frame means includes three connecting points, one upper center connecting point and two lower laterally spaced connecting points; and wherein said implement is provided with a remotely controlled hydraulic cylinder that is operatively connected between said upper center connecting point and the upper center hitching point of the associated tractor's three-point hitch, whereby by actuating said hydraulic cylinder the angle of said support arms can be varied and consequently the attitude of the bulk tobacco container support means disposed about the rearward end of said arms can be varied and adjusted accordingly.

3. The implement of claim 1 wherein said implement is provided with a pair of gussets, each gusset being secured between said upper transverse member and a respective rearwardly extending support arm.

4. The bulk tobacco container handling implement of claim 1 wherein each of said three connecting points includes a pair of laterally spaced forwardly projecting plates with the plates having transversely aligned openings formed therein.

* * * * *